US009885981B2

(12) United States Patent
Taniguchi

(10) Patent No.: US 9,885,981 B2
(45) Date of Patent: Feb. 6, 2018

(54) IMAGE FORMING DEVICE

(71) Applicant: KYOCERA Document Solutions Inc., Osaka-shi, Osaka (JP)

(72) Inventor: Susumu Taniguchi, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/313,956

(22) PCT Filed: Apr. 24, 2015

(86) PCT No.: PCT/JP2015/062556

§ 371 (c)(1),
(2) Date: Nov. 24, 2016

(87) PCT Pub. No.: WO2015/182313

PCT Pub. Date: Dec. 3, 2015

(65) Prior Publication Data

US 2017/0185005 A1 Jun. 29, 2017

(30) Foreign Application Priority Data

May 29, 2014 (JP) ..... 2014-110842

(51) Int. Cl.
*G03G 15/16* (2006.01)

(52) U.S. Cl.
CPC ..... *G03G 15/1605* (2013.01)

(58) Field of Classification Search
CPC ..... G03G 15/1605
See application file for complete search history.

(56) References Cited

U.S. PATENT DOCUMENTS

2007/0212108 A1 9/2007 Hozono et al.
2013/0272745 A1* 10/2013 Fukase ..... G03G 15/16 399/121

FOREIGN PATENT DOCUMENTS

JP H10147451 A 6/1998
JP 2007240834 A 9/2007

* cited by examiner

*Primary Examiner* — David M Gray
*Assistant Examiner* — Andrew V Do

(57) ABSTRACT

An image forming device includes a cover member, a conveying unit, a first rotor, a second rotor, a bearing unit, a biasing member, and a link member. The cover member includes a hook, and an opening/closing lever that moves the hook. The conveying unit is disposed on the inner side of the cover member, and is rotatably supported between an opened position and a closed position to the main body of the image forming device. The link member is swingably supported on the conveying unit, and is configured to engage with the bearing unit. By operating the opening/closing lever in a state where the conveying unit is in a closed position, the link member is pressed against the hook to swing so that the first rotor of the bearing unit should move in a direction away from the second rotor against biasing force from the biasing member.

5 Claims, 8 Drawing Sheets

IMAGE FORMING DEVICE

RELATED APPLICATIONS

The present application is a national stage entry according to 35 U.S.C. § 371 of PCT application No.: PCT/JP2015/062556 filed on Apr. 24, 2015, which claims priority from Japanese application No.: 2014-110842 filed on May 29, 2014 and is incorporated herein by reference in its entirety.

FIELD OF THE INVENTION

The present invention relates to an image forming device such as a copier, a printer, a facsimile, and a multifunction peripheral having a combination of such functions.

BACKGROUND

Conventional image forming devices such as copiers or printers are generally provided with a paper path extending in a vertical direction at the vicinity of the side face of the main body of the device for downsizing the overall system. The paper path extending in a vertical direction is provided with a pair of conveying rollers for conveying a sheet of paper. It is common to install a conveying unit having one roller of the pair of conveying rollers, a transfer roller which is pressed by an image carrier to be brought into contact with the image carrier to form a transfer nip part, and the like, and to design a structure capable of opening and closing the conveying unit in relation to the main body of the device for easy clearance of paper jams and maintenance of the device in a condition where a wide range of the paper path is exposed.

For example, the patent document 1 discloses a paper conveying device having at least two parallel paper paths where a paper jam occurred therein can be cleared from only one direction. This paper conveying device includes at least two swing guide plates for opening the at least two paper paths, an opening/closing mechanism for opening or closing the swing guide plates, and an exterior cover for opening and closing the main body of the device. The swing guide plates are configured to be opened or closed with the movement of an opening or closing action of the exterior cover.

The patent document 2 discloses a constitution, in which a transfer roller is provided with a bearing member that rotatably supports a rotation axis, a spring member that presses the bearing member to the side of a photoreceptor drum, and a bearing holder that houses the bearing member and supports the bearing member so that the bearing member is movable in the housing. In this constitution, when a cover member, which is provided with the transfer roller, is closed in relation to the main body of the device, a bearing member freely moves in the housing of the bearing holder on the side of the main body of the device, and the rotation axis of the transfer roller is fitted into a guiding groove of the bearing guide of the main body of the device so that the rotation axis is opposed to the guiding groove. Thus, the transfer roller is pressed against the photoreceptor drum so that the transfer roller is brought into contact with the photoreceptor, and thereby a nip part that enables nipped transfer of a recording medium is formed.

REFERENCES

Patent Documents

[Patent document 1] JP 10-147451 A
[Patent document 2] JP 2007-240834 A

SUMMARY OF THE INVENTION

Problem to be Solved by the Invention

In a conveying unit provided with a conveying roller and a transfer roller, which enables clearance of a paper jam and maintenance of the device under a condition where the conveying unit is opened or closed in relation to the main body of the device, a conveying roller or a transfer roller is pressed against the opposing transfer roller or image carrier with a relatively great pressing force so that a sufficient nip width (that is, paper conveying ability) should be maintained. When an angle between the direction of this pressing force and the direction of the orbital of opening/closing a conveying unit is large, force required to release pressing force imposes a load on opening or closing the conveying unit, and thus operability upon opening/closing the conveying unit is lowered.

In view of the state of the art, the present invention has an object to provide an image forming device which enables an easy release of pressing force between a roller installed in the convey unit and a rotor on the side of the main body of the device upon opening/closing operation of the conveying unit.

Means to Solve the Problem

To accomplish the above object, a first constitution of the present invention relates to an image forming device including a cover member, a conveying unit, a first rotor, a second rotor, a bearing unit, a biasing member, and a link member. The cover member includes a hook that is openably or closably supported in relation to the main body of the image forming device and is configured to engage with the main body of the image forming device, and an opening/closing lever that moves the hook to a position where the engagement between the hook and the main body of the image forming device is released. The conveying unit is disposed on the inner side of the cover member, and is rotatably supported between an opened position and a closed position in relation to the main body of the image forming device. The first rotor is rotatably supported on the inner side of the conveying unit. The second rotor is rotatably supported on the side of the main body of the image forming device. The bearing unit is supported movably to the conveying unit, and rotatably supports the rotation axis of the first rotor. The biasing member biases the bearing unit so as to press the first rotor towards the axial core of the second rotor. The link member is swingably supported on the conveying unit, and is configured to engage with the bearing unit. When the conveying unit is in a closed position, the first rotor is pressed by the second rotor to form a nip part for conveying a recording medium. In the image forming device, by operating the opening/closing lever in a state where the conveying unit is in a closed position, the link member is pressed by the hook to swing so that the first rotor of the bearing unit should move away from the second rotor against biasing force from the biasing member.

Effect of the Invention

According to the first constitution of the present invention, the pressure contact state between a first rotor and a second rotor can be released by operating the opening/closing lever in a state where the conveying unit is in a closed position. Thus, the conveying unit can be released by relatively smaller force than the conventional devices since the force of the first rotor to press the second rotor does not impose a load upon operation of opening/closing operation. As a result, operability of the conveying unit is improved.

DETAILED DESCRIPTION

Figure 1:
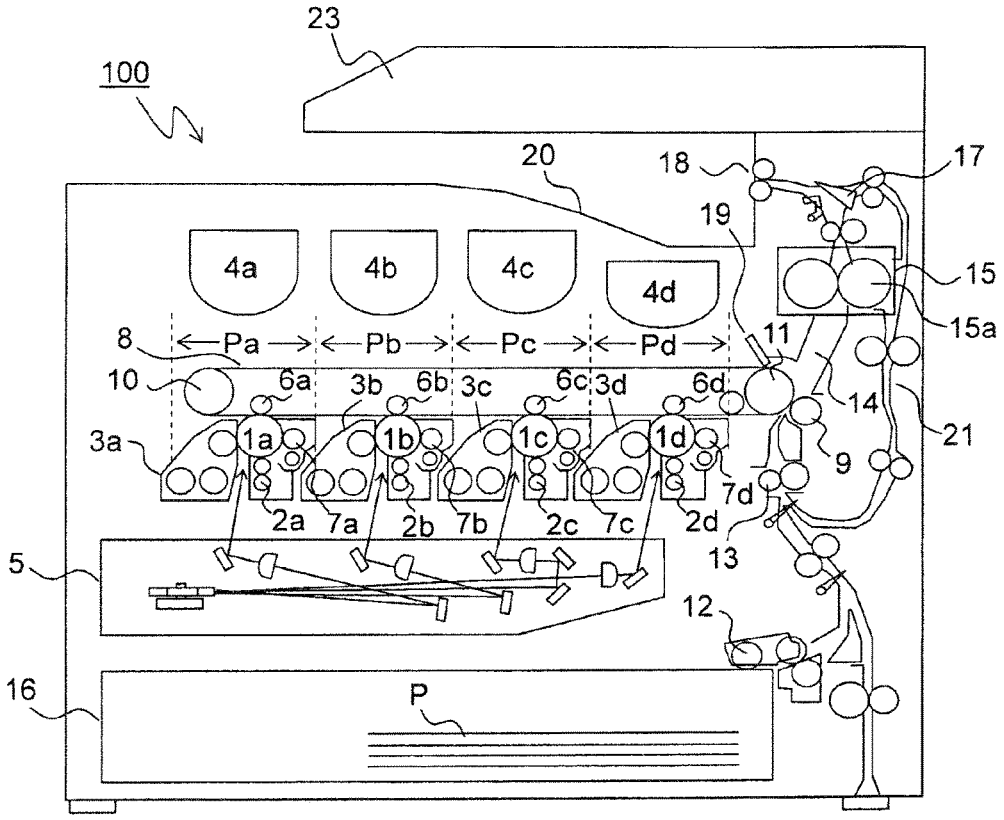
FIG. 1 is a schematic sectional view of the entire constitution of the image forming device 100 according to one embodiment of the present invention.

An embodiment of the present invention is now described with reference to drawings. FIG. 1 is a sectional view of the schematic constitution of the image forming device 100 according to one embodiment of the present invention. In this embodiment, the image forming device 100 is a four tandem-type color copier that forms an image using four photoreceptor drums 1*a*, 1*b*, 1*c* and 1*d*, corresponding to four different colors (namely, magenta, cyan, yellow and black), which are parallely arranged in the color copier.

In a case illustrated in FIG. 1, four image forming parts Pa, Pb, Pc and Pd are disposed sequentially in this order from the left side of FIG. 1 in the main body of the image forming device 100. These image forming parts Pa, Pb, Pc and Pd are disposed so as to form images of four different colors (namely, magenta, cyan, yellow, and black), and respectively form magenta, cyan, yellow, and black images in a sequence each through the steps of electrification, exposure to light, development, and transfer.

These image forming parts Pa, Pb, Pc and Pd are respectively provided with the photoreceptor drums 1*a*, 1*b*, 1*c*, and 1*d* that each carry a visible image (a toner image) of a predetermined color. Further, an intermediate transfer belt 8 that rotates counterclockwise in FIG. 1 is provided adjacently to the image forming parts Pa, Pb, Pc, and Pd. Toner images formed on these photoconductor drum 1*a*, 1*b*, 1*c*, and 1*d* are sequentially transferred on the intermediate transfer belt 8, which is moving while contacting with the photoconductor drum 1*a*, 1*b*, 1*c*, and 1*d*. The toner images are then transferred to a paper sheet P at a time on a secondary transfer roller 9, and then fixed on the paper sheet P in a fixing unit 15. Then, the paper sheet P is discharged from the image forming device 100. The image formation process on the photoreceptor drums 1*a*, 1*b*, 1*c*, and 1*d* is performed during clockwise rotation the photoreceptor drums 1*a*, 1*b*, 1*c*, and 1*d* are in FIG. 1.

The paper sheet P to which toner images are transferred is stored in a paper cassette 16 disposed at a lower part of the main body of the image forming device 100, and is conveyed to the secondary transfer roller 9 through a paper feed roller 12, a pair of resist rollers 13, and a paper path 14. A sheet made of a dielectric resin is used as the intermediate transfer belt 8, and a belt which does not have any joints (namely, a seamless belt) is mainly used. The intermediate transfer belt 8 and the secondary transfer roller 9 are rotationally driven at the same line speed as the photoconductor drums 1*a*, 1*b*, 1*c*, and 1*d* by a belt driving motor (not illustrated). In the downstream of the secondary transfer roller 9, a blade-like belt cleaner 19 to remove toners remained on the surface of the intermediate transfer belt 8 is disposed.

Next, the image forming parts Pa, Pb, Pc, and Pd are described. Around and below the rotatably disposed photoreceptor drums 1*a*, 1*b*, 1*c*, and 1*d*, electrification devices 2*a*, 2*b*, 2*c*, and 2*d* to electrify the photoreceptor drums 1*a*, 1*b*, 1*c*, and 1*d*, an exposure unit 5 to expose the photoreceptor drums 1*a*, 1*b*, 1*c*, and 1*d* to light on the basis of the image data, developing devices 3*a*, 3*b*, 3*c*, and 3*d* to develop electrostatic latent images formed on the photoreceptor drums 1*a*, 1*b*, 1*c*, and 1*d* by a toner, and cleaning devices 7*a*, 7*b*, 7*c* and 7*d* to recover or remove developers (toners) remained after the transfer of toner images on the photoreceptor drums 1*a*, 1*b*, 1*c*, and 1*d* are disposed.

The image reader 23 is composed of a scanning optical arrangement that loads a scanner lamp to light up a manuscript at the time of copying and a mirror to change an optical path of reflected light from the manuscript, a condensing lens that condenses reflected light that is reflected on a manuscript, and forms an image, and a CCD sensor that converts the condensed light of the formed image into electrical signals, and the like (all of them are not illustrated). The image reading part 23 reads an image of a manuscript and converts into image data.

When copying operation is performed, the image data of the manuscript is converted into a read image signal in the image reader 23. Meanwhile, the surfaces of photoconductor drums 1*a*, 1*b*, 1*c*, and 1*d* are evenly electrified by electrification devices 2*a*, 2*b*, 2*c*, and 2*d*, and then the photoconductor drums 1*a*, 1*b*, 1*c*, and 1*d* are irradiated with light on the basis of image data by the exposure unit 5, and electrostatic latent images corresponding to the image data are formed on the photoconductor drums 1*a*, 1*b*, 1*c*, and 1*d*. The developing devices 3*a*, 3*b*, 3*c*, and 3*d* include developing rollers (developer carriers) disposed at opposed positions to the photoconductor drums 1*a*, 1*b*, 1*c*, and 1*d*, and are each filled with a predetermined quantity of a two-component developer that includes one toner of magenta, cyan, yellow and black.

When the proportion of the toner in a two-component developer filled in each of the developing devices 3*a*, 3*b*, 3*c*, and 3*d* falls below the specified value by the formation of toner images which will be described below, developers are supplied in the developing devices 3*a*, 3*b*, 3*c*, and 3*d* from containers 4*a*, 4*b*, 4*c*, and 4*d*. The toners in these developers are supplied on the photoconductor drums 1*a*, 1*b*, 1*c*, and 1*d* by the developing devices 3*a*, 3*b*, 3*c*, and 3*d* and electrostatically attach to corresponding photoconductor drums 1*a*, 1*b*, 1*c*, and 1*d*. Thus, toner images which correspond to electrostatic latent images formed by exposure to light in the exposure unit 5 are formed.

Then, a predetermined transfer voltage is applied between primary transfer rollers 6*a*, 6*b*, 6*c*, and 6*d* and corresponding photoconductor drums 1*a*, 1*b*, 1*c*, and 1*d* by the primary transfer rollers 6*a*, 6*b*, 6*c*, and 6*d*. Thus, toner images of magenta, cyan, yellow, or black on the photoconductor drums 1*a*, 1*b*, 1*c*, and 1*d* are primarily transferred on the intermediate transfer belt 8. These four-colored images are formed with a predetermined positional relationship for predetermined full color image formation. The primary transfer rollers 6*a*, 6*b*, 6*c*, and 6*d* are rotationally driven at the same line speed as the photoconductor drums 1*a*, 1*b*, 1*c*, and 1*d* and the intermediate transfer belt 8 by a primary transfer driving motor (not illustrated). Then, for formation of a new electrostatic latent image which will be sequentially performed, the toner remained on the surface of the photoconductor drums 1*a*, 1*b*, 1*c*, and 1*d* are removed by corresponding cleaning units 7*a*, 7*b*, 7*c*, and 7*d*.

The intermediate transfer belt 8 is bridged over the driven roller 10 and the driving roller 11. When the intermediate transfer belt 8 starts counterclockwise rotation with a rotation of the driving roller 11 driven by the belt driving motor, a paper sheet P is conveyed from the pair of resist rollers 13 to the nip part (secondary transfer nip part) formed between the secondary transfer roller 9, which is disposed adjacently to the intermediate transfer belt 8, and the intermediate transfer belt 8 at a predetermined timing. A full color image is secondarily transferred on a paper sheet P in the nip part. The paper sheet P on which toner images are transferred is conveyed to the fixing unit 15 through the paper path 14.

The paper sheet P conveyed to the fixing unit 15 is heated and pressurized when passing through the nip part of a pair of fixing rollers 15*a* (fixing nip part). At the time, toner images are fixed on the surface of the paper sheet P, whereby a predetermined full color image on the paper sheet is formed. The conveying direction of the paper sheet P on which a full color image is formed is sorted by a branching part 17 that diverges in plural directions. When an image is formed only on one side of the paper sheet P, the paper sheet P is directly discharged on the discharge tray 20 by a pair of discharging rollers 18.

Meanwhile, when images are formed on both sides of the paper sheet P, part of the paper sheet P which passed through the fixing unit 15 are once made to project from the pair of discharging rollers 18 to the exterior of the device. Then, the paper sheet P is sorted at the branching part 17 to the inversion paper path 21 by inversely rotating the pair of discharging rollers 18 and is conveyed again to the secondary transfer roller 9 in a state where the surface on which the image has been formed is inversed. Then, the next image formed on the intermediate transfer belt 8 is transferred to the surface, on which no image is formed, of the paper sheet P by the secondary transfer roller 9. The paper sheet P is conveyed to the fixing unit 15, and a toner image is fixed. After then, the paper sheet P is discharged on the discharge tray 20 by the pair of discharging rollers 18.

Figure 2:
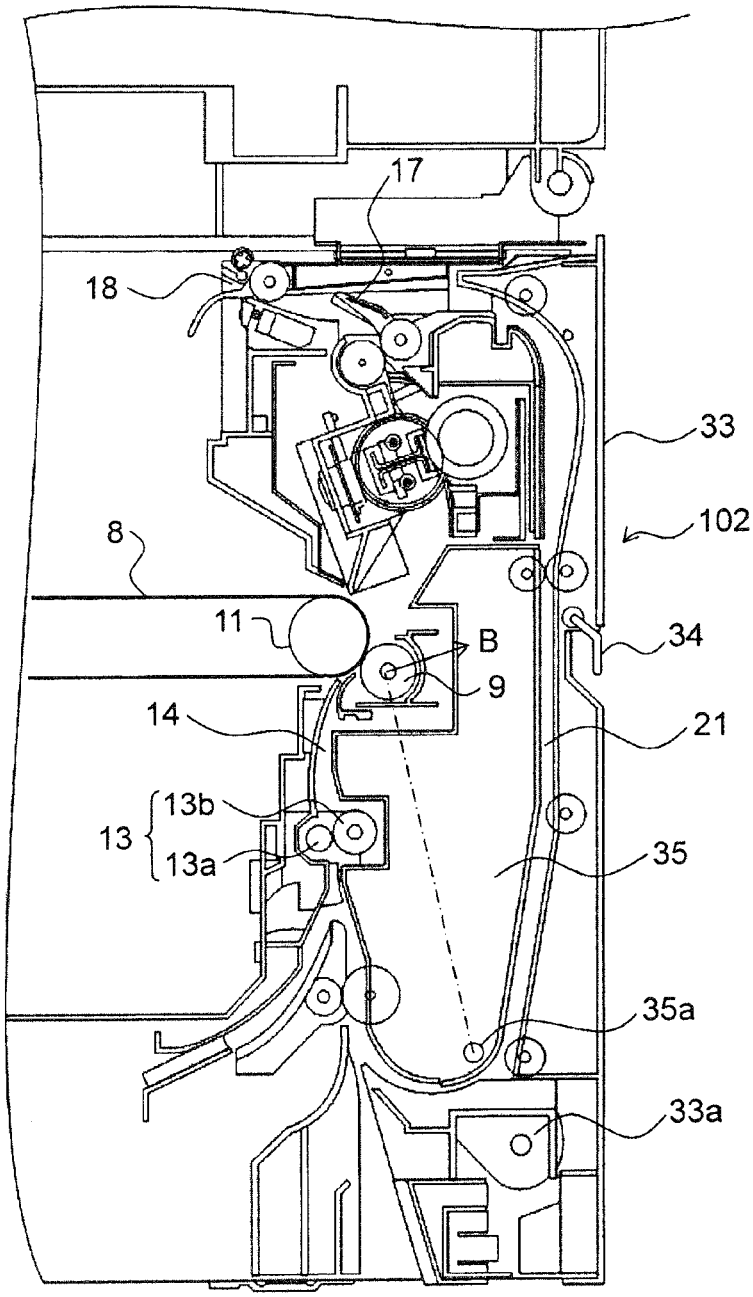
FIG. 2 is a sectional view around the paper path 14 and the inversion paper path 21 in the image forming device 100 of this embodiment.
Figure 3:
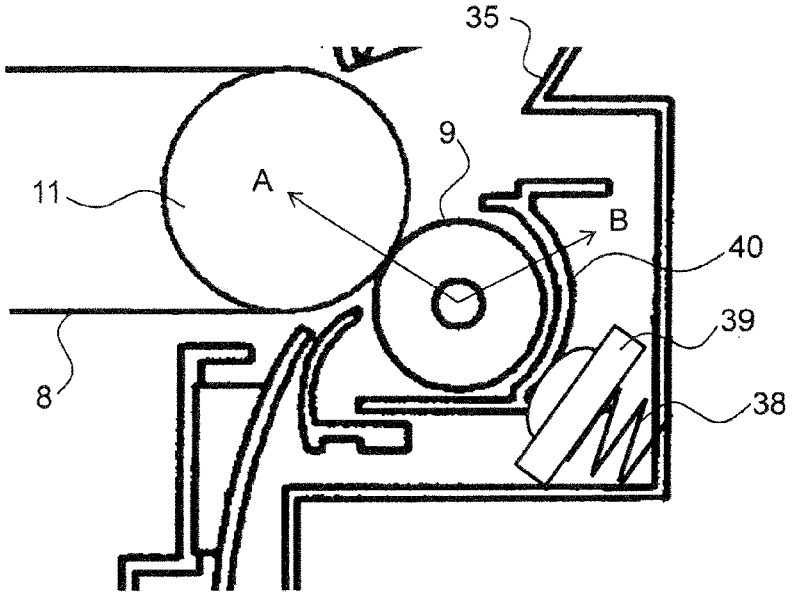
FIG. 3 is a partial enlarged view around the secondary transfer roller 9 in FIG. 2.
Figure 4:
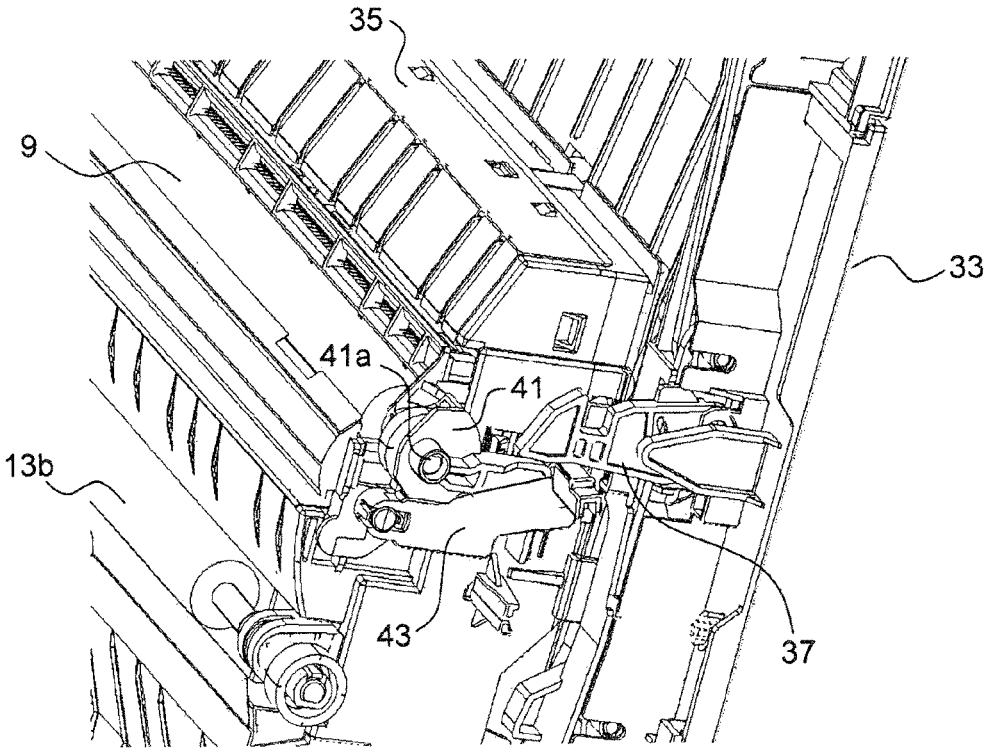
FIG. 4 is a perspective view of the side cover 33 and the conveying unit 35 seen from the front side of the image forming device 100.

FIG. 2 is a sectional view around the paper path 14 and the inversion paper path 21 in the image forming device 100 of this embodiment. FIG. 3 is a partial enlarged view around the secondary transfer roller 9 in FIG. 2. FIG. 4 is a perspective view of the side cover 33 and the conveying unit 35 seen from the front side of image forming device 100. FIG. 4 illustrates a constitution of the side cover 33 and the conveying unit 35 at one end (the front side) in the axial direction of the conveying unit 35. The constitution and the operation of the side cover 33 and the conveying unit 35 at the other end (the back side) are the same as the constitution and the operation at the front side.

The side cover 33 constitutes the side face 102 of the image forming device 100, and is rotatably supported at the fulcrum 33*a* that is provided in a lower part of the main body of the image forming device 100 body. The inner surface of the side cover 33 constitutes one conveying face of the inversion paper path 21. A wide range of the inversion paper path 21 is exposed by rotating only the side cover 33 in the opening direction in relation to the image forming device 100. By rotating the side cover 33 together with the conveying unit 35 in an opening direction, the conveying unit 35 moves away from the main body of the image forming device 100, and thereby a wide range of the paper path 14 is exposed. Meanwhile, by rotating the side cover 33 together with the conveying unit 35 in a closing direction, the conveying unit 35 is brought into contact with the side of the main body of the image forming device 100, and the secondary transfer roller 9 is pressed to push the driving roller 11.

The inside of the side cover 33 is provided with the conveying unit 35. The conveying unit 35 is rotatably supported around a spindle 35*a* by the main body of the image forming device 100, and constitutes part of the conveying surfaces of the paper path 14 and the inversion paper path 21. The inversion paper path 21 extends vertically along the side face 102 of the image forming device 100 between the side cover 33 and the conveying unit 35, and has a structure of substantially C-shaped, curved shape which finally joins the paper path 14. On the inner surface of the conveying unit 35, one roller 13*b* constituting the pair of the resist roller 13 and the secondary transfer roller 9 which is a first roller are arranged sequentially in this order from the upstream side (bottom of FIG. 2) of the conveying direction of a paper sheet. The secondary transfer roller 9 pushes the driving roller 11, which is a second roller, with sandwiching the intermediate transfer belt 8.

As illustrated in FIG. 3, the secondary transfer roller 9 is rotatably supported by the bearing unit 40. The bearing unit 40 is swingably supported to the conveying unit 35 around a swing axis 45 (see FIG. 5) as the fulcrum, and is biased in the direction (arrow A direction) towards the axial core of the driving roller 11 by a compression spring 38 and a pressing member 39. In the state of FIG. 2, the secondary transfer roller 9 is placed at the position where the secondary transfer roller 9 is brought into contact with the driving roller 11 at a predetermined pressure by biasing force from the compression spring 38, to form a secondary transfer nip part with the intermediate transfer belt 8.

As illustrated in FIG. 4, a hook 37 is disposed at a side edge of the side cover 33. The hook 37 holds the side cover 33 in a closed state by engaging with the engagement pins 47 (see FIG. 10) which are disposed on each of the front side frame 101*a* and the back side frame 101*b* of the main body of the image forming device 100. The hook 37 is biased in the direction to engage with the engagement pins 47 (the upper direction in FIG. 4) by a spring (not illustrated). The hook 37 is disposed to move with the opening/closing lever 34 of the side cover 33, which is connected to the rotating axis of the hook 37. By holding and drawing up the bottom end of the opening/closing lever 34, the rotating axis rotates to swing the hook 37, to release the engagement between the hook 37 and the engagement pins. Thus, the side cover 33 can be opened.

The bearing guide member 41 are disposed at the both ends of the bearing unit 40. The bearing guide member 41 has a positioning boss 41*a* that projects coaxially on the axis of rotation of secondary transfer roller 9. The secondary transfer roller 9 is pressed by the driving roller 11 in a condition where the positioning boss 41 is fitted into the second guide groove 53 (see FIG. 10) which is formed on the side frame 101 of the main body of the image forming device 100.

To clear a paper jam occurred in the inversion paper path 21, the inversion paper path 21 is opened by rotating only the side cover 33 clockwise from the position illustrated in FIG. 2. Meanwhile, to clear a paper jam occurred in the paper path 14, the paper path 14 is opened by rotating the conveying unit 35 and the side cover 33 clockwise. At this time, the secondary transfer roller 9 moves away from the driving roller 11, and one roller 13*b*, which constitutes the pair of the resist rollers 13, moves away from the other roller 13*a*. After a paper sheet is removed, the conveying unit 35 and the side cover 33 are rotated counterclockwise in FIG. 2 to return to the original state illustrated in FIG. 2. Thus, the conveying unit 35 is placed at the position where the secondary transfer roller 9 is pressed by the driving roller 11 so as to be brought into contact with the driving roller 11, and the roller 13*b* is pressed by the roller 13*a* so as to be brought into contact with the roller 13*a*.

When the conveying unit 35 is rotated in the opening direction from the state illustrated in FIG. 2, the secondary transfer roller 9 also moves over an arc around the spindle 35*a* in the direction represented by the arrow B. At this time, the secondary transfer roller 9 is pressed by the compression spring 38 and the pressing member 39 in the direction represented by the arrow A. As illustrated in FIG. 3, the angle between the pressing direction (direction represented by the arrow A) of secondary transfer roller 9 and the moving direction (direction represented by the arrow B) of the secondary transfer roller 9 becomes relatively great as an angle of near 90°. Therefore, the pressing force imposed on the driving roller 11 from the secondary transfer roller 9 imposes a load upon rotation of the conveying unit 35, and operability of the conveying unit 35 is lowered.

Thus, the image forming device 100 of the present embodiment is provided with a roller retraction mechanism that moves the secondary transfer roller 9 in a direction away from the driving roller 11 at the time of operation of the conveying unit 35. The roller retraction mechanism consists of a hook 37, a bearing guide member 41, and a link member 43 placed between the hook 37 and the bearing guide member 41.

Figure 5:
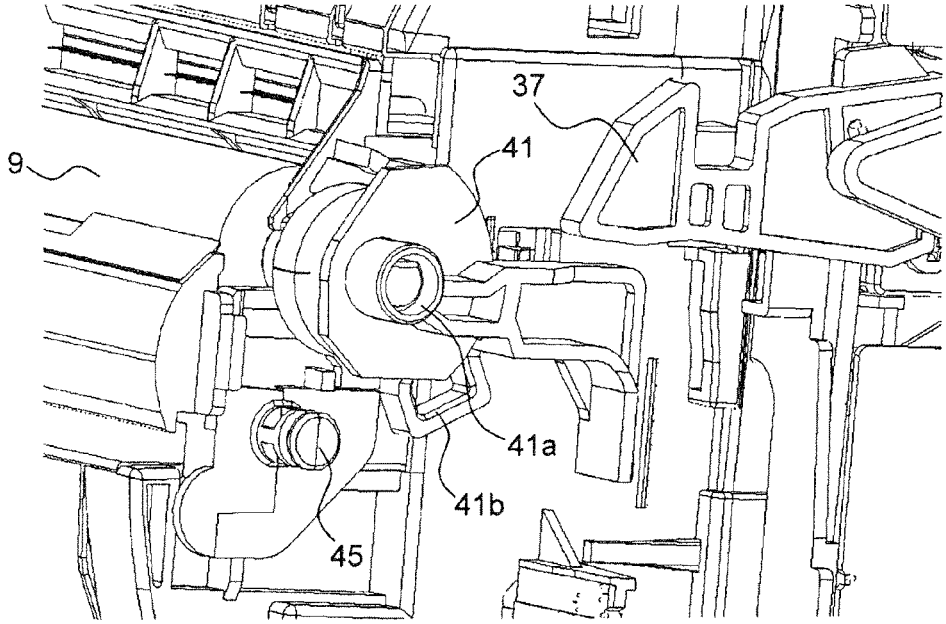
FIG. 5 is a partial enlarged view around the bearing guide member 41 from which the link member 43 is removed.
Figure 6:
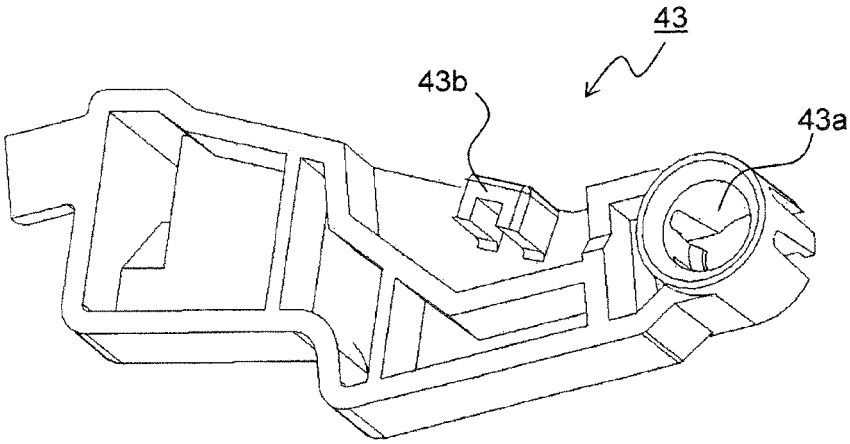
FIG. 6 is a perspective view of the link member 43 seen from the back side (the side of the bearing guide member 41).
Figure 7:
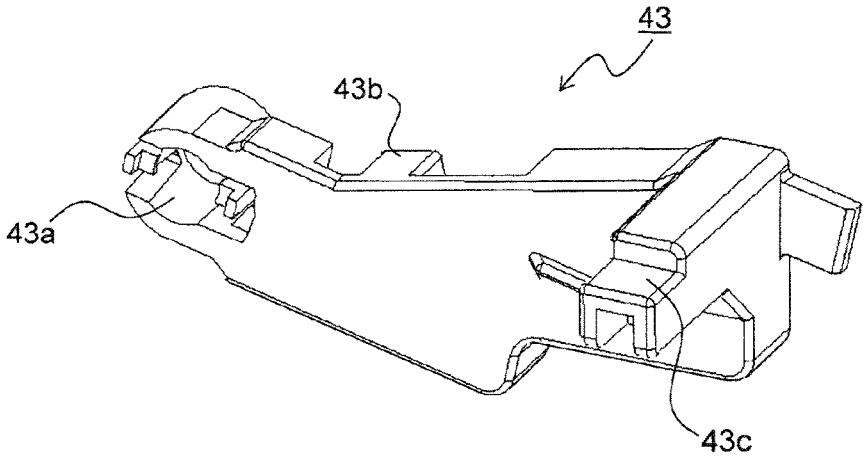
FIG. 7 is a perspective view of the link member 43 seen from the front side (the side of the hook 37).

FIG. 5 is a partial enlarged view around the bearing guide member 41 from which the link member 43 is removed. FIGS. 6 and 7 are perspective views of the link member 43 seen from the back side (the side of the bearing guide member 41) or from the front side (the side of the hook 37).

The link member 43 is a resin-made member having a bearing hole 43*a*, an engagement part 43*b*, and an arm 43*c*. The bearing hole 43*a* is swingably fitted to the swing axis 45 provided on the bearing unit 40. The engagement part 43*b* is formed on the back side of the link member 43 so as to engage with the engaged part 41*b* which is formed on the bearing guide member 41. The arm 43*c* projects into the front surface of the link member 43 to be brought into contact with the lower end of the hook 37.

Then, operations on opening the paper path 14 by rotating the conveying unit 35 are described. First of all, by pulling up the bottom end of the opening/closing lever 34 (see FIG. 2) with a finger, the hook 37, which is provided on both edges of the side cover 33, rotates to release engagement with the engagement pins 47 on the side of the main body of the image forming device 100.

Figure 8:
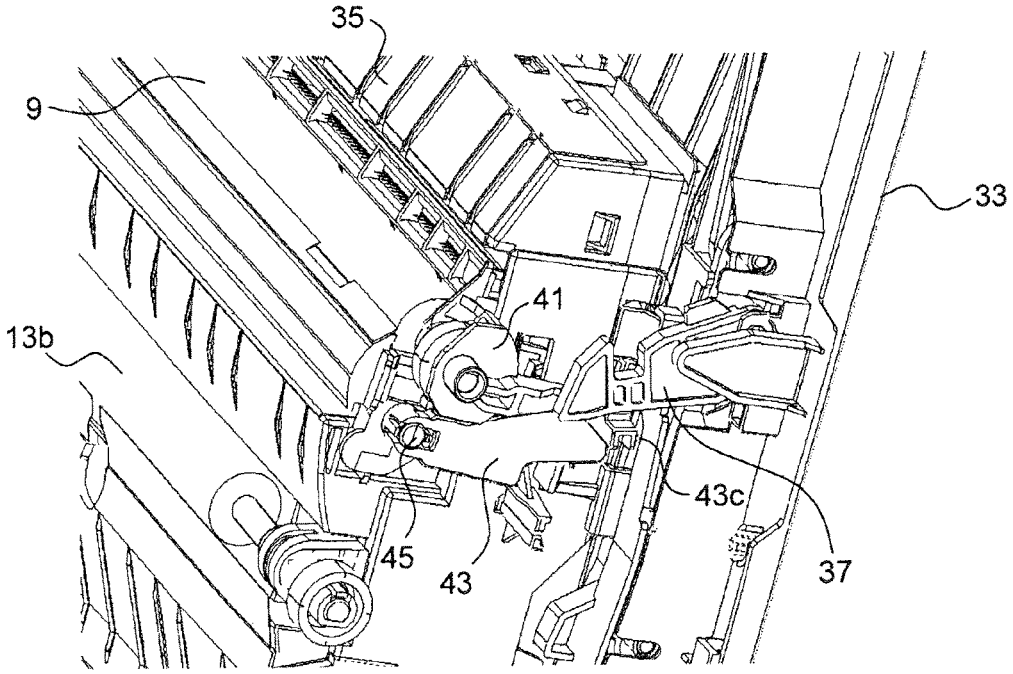
FIG. 8 is a perspective view illustrating a condition where the hook 37 pushes down the arm 43*c* of the link member 43.

At this time, as illustrated in FIG. 8, the bottom end of the hook 37 pushes down the arm 43*c* of the link member 43, whereby the link member 43 rotates in the lower direction (the clockwise direction in FIG. 8) around the swing axis 45 as the fulcrum. Then, the bearing guide member 41 is also pulled down in the lower direction by the rotation of the link member 43 because the engagement part 43*b* of the link member 43 engages with the engaged part 41*b* (see FIG. 5) of bearing guide member 41. As a result, the bearing unit 40 moves in the lower direction against biasing force from the compression spring 38, and the secondary transfer roller 9 moves away from the driving roller 11.

Because the pressing force of the secondary transfer roller 9 to the driving roller 11 does not impose a load upon opening operation of the conveying unit 35, the conveying unit 35 can be released by a smaller force compared with conventional devices. Thus, operability of the conveying unit 35 is improved. In this embodiment, the swing fulcrum of the link member 43 and the swing axis 45 of the bearing unit 40 are common. However, the swing fulcrum of the link member 43 may be disposed on the conveying unit 35 separately from the swing axis 45.

Figure 9:
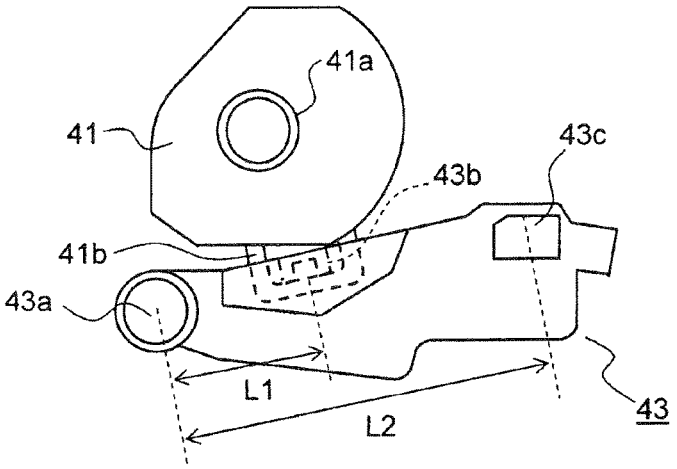
FIG. 9 is a view illustrating the relation between the distance L1 from the bearing hole 43*a* of link member 43 to the engagement part 43*b* and the distance L2 from the bearing hole 43*a* to the arm 43*c*.

As illustrated in FIG. 9, assuming that the distance from the swing fulcrum (the bearing hole 43*a*) of the link member 43 to the point of action (the engagement part 43*b*) into which the link member 43 draws the bearing guide member 41 (the bearing unit 40) is set as L1, and the distance from the swing fulcrum to the point of action (the arm 43*c*) to rotate the link member 43 with the hook 37 is set as L2, the L1 becomes a half or less of the L2. This enables to reduce required force to operate the opening/closing lever using the principle of leverage.

Figure 10:
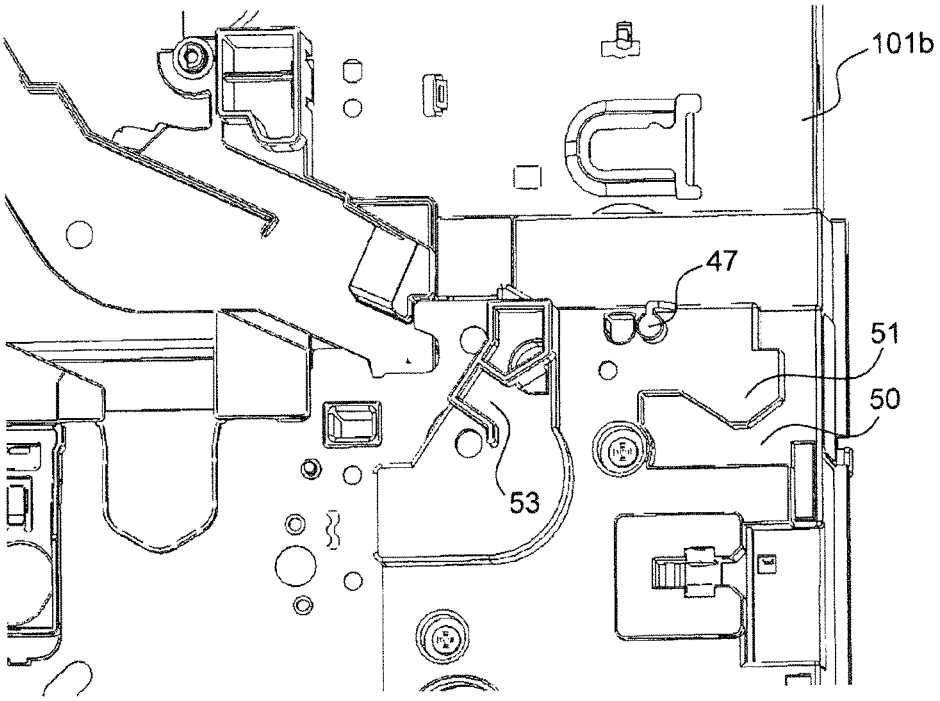
FIG. 10 is an enlarged view of the part overlapping the conveying unit 35 in the back side frame 101*b* of the main body of the image forming device 100.

FIG. 10 is an enlarged view of the part overlapping the conveying unit 35 in the back side frame 101*b* of the main body of the image forming device 100. On the back side frame 101*b*, the engagement pins 47 with which the hook 37 of the side face cover 33 is to be engaged, a first guide groove 50 that guides the link member 43, and a second guiding groove 53 that guides the positioning boss 41*a* of the bearing guide member 41 are formed. On the top surface of the first guiding groove 50, a guide element 51 that is brought into contact with the arm 43 and makes the link member 43 to swing is formed. Explanation of the front side frame 101*a* of image forming device 100 is omitted because it has similar constitution to the back side frame 101*b* except that it is a mirror image of the back side frame 101*b*.

Then, operations on closing the paper path 14 by rotating the conveying unit 35 are described. When the side cover 33 and the conveying unit 35 which are in an opened position are rotated counterclockwise, the arm 43*c* of the link member 43 is guided into the first guiding groove 50.

Figure 11:
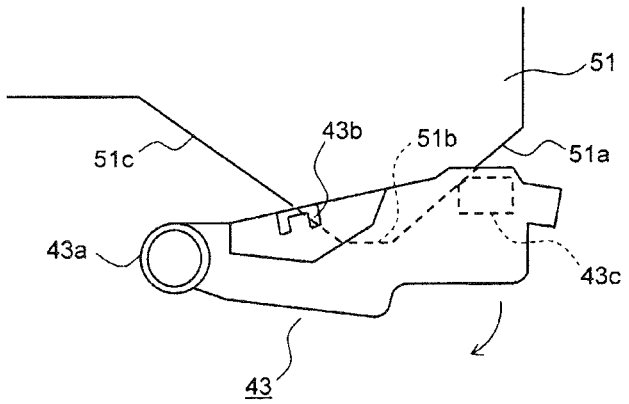
FIG. 11 is a partial enlarged view illustrating a condition where the conveying unit 35 is rotated by a predetermined amount in the closing direction from an opening state, whereby the arm 43*c* of the link member 43 is brought into contact with a first guide face 51*a* of the guide element 51.

FIG. 11 is a partial enlarged view illustrating a condition where the conveying unit 35 is rotated by a predetermined amount in the closing direction from an opened state, whereby the arm 43*c* of the link member 43 is brought into contact with the guide element 51. As illustrated in FIG. 11, the guide element 51 has a first guide surface 51*a*, a second guide surface 51*b*, and a third guide surface 51*c* arranged in this order from the upstream (the right direction in FIG. 11) of the arm 43*c*.

Then, the conveying unit 35 is rotated in the closing direction (the counterclockwise direction in FIG. 2) by a predetermined amount, the link member 43 further moves to the closing direction together with the conveying unit 35. The link member 43 is biased in the upper direction (the counterclockwise direction in FIG. 11) by biasing force from the compression spring 38 that biases the bearing unit 40. At this time, the arm 43*c* of the link member 43 moves in the lower direction along the first guide surfaces 51*a*. Thus, the link member rotates in a lower direction (the clockwise direction in FIG. 11) against the biasing force from the compression spring 38.

Figure 12:
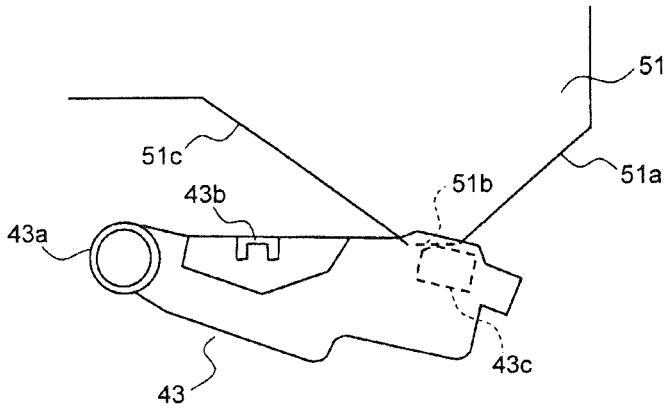
FIG. 12 is a partial enlarged view illustrating a condition where the conveying unit 35 is further rotated from the condition illustrated in FIG. 11, whereby the arm 43*c* is brought into contact with a second guide face 51*b*.

As illustrated in FIG. 12, when the conveying unit 35 rotates to the position where the arm 43*c* is brought into contact with the second guide surface 51*b*, the link member 43 rotates to the lowest point, and the bearing guide member 41 that engages with the link member 43 is also drawn down in the lower direction. As a result, the bearing unit 40 also moves to the lower direction against the biasing force from the compression spring 38, and the secondary transfer roller 9 retracts in the lower direction together with the bearing unit 40.

Figure 13:
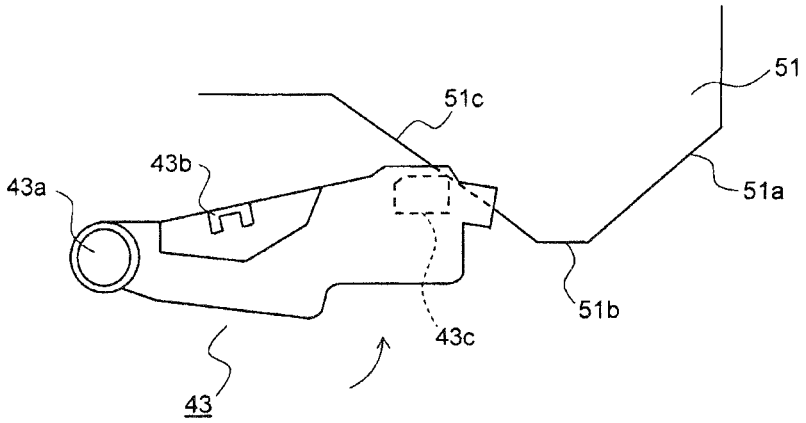
FIG. 13 is a partial enlarged view illustrating a condition where the conveying unit 35 is further rotated from the condition illustrated in FIG. 12, whereby the arm 43*c* moves along a third guide face 51*c*.

When the conveying unit 35 is further rotated in the closing direction by a predetermined amount, the link member 43 further moves to the closing direction with the conveying unit 35. As a result, as illustrated in FIG. 13, the biasing force from the compression spring 38 to rotate the link member 43 in the upper direction (the counterclockwise direction in FIG. 13) is imposed on the link member 43, and thus, the arm 43*c* moves in the upper direction along the third guide surface 51*c*.

Figure 14:
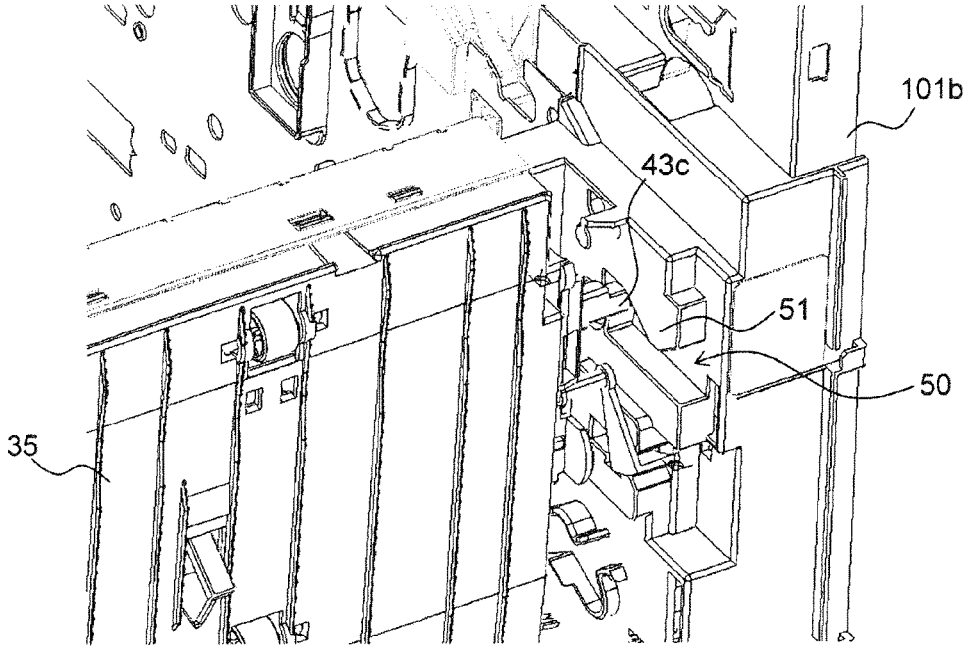
FIG. 14 is a partial perspective view of the conveying unit 35 which is rotated until the conveying unit 35 completely becomes a closed state in relation to the main body of the image forming device 100.

FIG. 14 is a partial perspective view of the conveying unit 35 which is rotated until the conveying unit 35 completely becomes a closed state in relation to the main body of the image forming device 100. As illustrated in FIG. 14, when the side cover 33 and the conveying unit 35 are rotated to a completely closed state, the arm 43*c* of the link member 43, which is disposed at the side edge of the conveying unit 35, fits into the deepest part of the first guide groove 50 that is formed on each of the front side frame 101*a* and the back side frame 101*b*. The positioning boss 41*a* of the bearing guide member 41 is fitted into the second guiding groove 53 (see FIG. 10) that is formed on each of the front side frame 101*a* and the back side frame 101*b*. Thus, the secondary transfer roller 9 is pressed by the driving roller 11, and a transfer nip part is formed between the secondary transfer roller 9 and the intermediate transfer belt 8. The hook 37 of the side cover 33 engages with the engagement pins 47, whereby the conveying unit 35 and the side cover 33 are held in a closed state.

As described above, the secondary transfer roller 9 once retracts in the lower direction (the direction away from the driving roller 11) in the course of closing the conveying unit 35, and then moves in the upper direction (the direction to be brought into contact with the driving roller 11 by pressure). Thus, interference between the secondary transfer roller 9 and the driving roller 11 can be prevented at the time of the closing operation of the conveying unit 35, and the conveying unit 35 can be closed smoothly.

As illustrated in FIG. 12, when the conveying unit 35 is closed, a load to compress the compression spring 38 causes until the arm 43*c* travels over the second guide surfaces 51*b*. As illustrated in FIG. 13, after the arm 43*c* has traveled over the second guide surface 51*b*, the arm 43*c* moves to the inside (the left direction in FIG. 13) of the image forming device 100 along the third guide surfaces 51*c* by restoring force of the compressed compression spring 38. That is, the biasing force of the compression spring 38 acts as force to draw the conveying unit 35, and thus an assistant force on closing the conveying unit 35 can be imparted. Also, the operator can feel a snapping operation feeling, and thereby recognizes the completion of rotation of the conveying unit 35 to a predetermined position.

The present invention is not limited to the embodiment mentioned above, and various modifications are possible without departing from the purpose of the invention. For example, in the embodiment mentioned above, the bearing guide member 41 is disposed on both ends of the bearing unit 40, and the bearing unit 40 engages with the link member 43 via the bearing guide member 41. However, the bearing unit 40 may engage directly with the link member 43 without intervention of the bearing guide member 41.

In the embodiment mentioned above, the roller retraction mechanism in the combination of the secondary transfer roller 9 with the driving roller 11 are described as an example. However, the present invention is not limited to this embodiment. Alternatively, the present invention may be applied to pressure contacting or separation of other pairs of rollers disposed in the conveying unit 35, such as the pair of resist rollers 13. Alternatively, the present invention may be applied to pressure contacting or separation of a transfer roller and a photoconductor drum in an image forming apparatus of the direct-transfer system.

INDUSTRIAL APPLICABILITY

The present invention can be applied to image forming devices such as a copier, a printer, a facsimile, and a multifunction peripheral having a combination of such functions. The present invention can provide an image forming device which can easily release the pressing force between a roller disposed on a conveying unit and a rotor of the main body of a device at the time of the opening and closing operation of the conveying unit.

The invention claimed is:

1. An image forming device, comprising:

a cover member that includes a hook that is openably or closably supported to the main body of the image forming device and is configured to engage with the main body of the image forming device, and an opening or closing lever that moves the hook to a position where the engagement between the hook and the main body of the image forming device is released, a conveying unit that is disposed on the inner side of the cover member, and is rotatably supported between an opened position and a closed position in relation to the main body of the image forming device, a first rotor that is rotatably supported on the inner side of the conveying unit, a second rotor that is rotatably supported on the side of the main body of the image forming device, a bearing unit that is movably supported in relation to the conveying unit, and rotatably supports the rotation axis of the first rotor, and a biasing member that biases the bearing unit so as to press the first rotor towards the axial core of the second rotor, wherein, in the image forming device, when the conveying unit is in a closed position, the first rotor is pressed by the second rotor to form a nip part for conveying a recording medium, the image forming device has a link member that is swingably supported on the conveying unit, and is configured to engage with the bearing unit, and, by operating the opening or closing lever in a state where the conveying unit is in a closed position, the link member is pressed by the hook to swing so that the first rotor of the bearing unit should move away from the second rotor against biasing force from the biasing member.

2. The image forming device according to claim 1, wherein the link member is provided with a bearing hole into which the swing axis of the conveying unit is to be swingably received, an engagement part to be coupled to the bearing part, and an arm that is brought into contact with the hook, and, assuming that the distance the bearing hole to the engagement part is set as L1, and the distance from the bearing hole to the arm is set as L2, the image forming device satisfies the relation of $2L1 \leq L2$.

3. The image forming device according to claim 1, wherein the main body side of the image forming device is provided with a pair of frames one of which is opposed to another on the edge part of the conveying unit, each of the frames is provided with a guiding groove with which the link member engages when the conveying unit rotates from an opened position to a closed position, and by the swing of the link member along the guide groove with rotation of the conveying unit from an opened position to a closed position, the bearing unit moves the first rotor in a direction away from the second rotor, and then moves the first rotor in a direction to press the second rotor by the first rotor.

4. The image forming device according to claim 3, wherein the biasing member imposes biasing force in a direction to rotate the conveying unit to a closed position when the link member swings along the guiding groove and the bearing unit moves the first rotor to a direction to press the second rotor by the first rotor.

5. The image forming device according to claim 1, wherein the first rotor is a secondary transfer roller, the second rotor is a driving roller to drive an intermediate transfer belt that carries a toner image, and, at a secondary transfer nip part to be formed between the secondary transfer roller and the intermediate transfer belt, a toner image carried by the intermediate transfer belt is transferred to a recording medium.

* * * * *